US009854857B2

(12) United States Patent
Kuusela

(10) Patent No.: US 9,854,857 B2
(45) Date of Patent: Jan. 2, 2018

(54) FUNCTIONAL ARTICLE OF CLOTHING

(71) Applicant: Niklas Kuusela, Helsinki (FI)

(72) Inventor: Niklas Kuusela, Helsinki (FI)

( * ) Notice: Subject to any disclaimer, the term of this patent is extended or adjusted under 35 U.S.C. 154(b) by 0 days.

(21) Appl. No.: 14/911,951

(22) PCT Filed: Aug. 7, 2014

(86) PCT No.: PCT/FI2014/050612

§ 371 (c)(1),
(2) Date: Feb. 12, 2016

(87) PCT Pub. No.: WO2015/022446

PCT Pub. Date: Feb. 19, 2015

(65) Prior Publication Data

US 2016/0192718 A1 Jul. 7, 2016

(30) Foreign Application Priority Data

Aug. 14, 2013 (FI) ..... 20135831

(51) Int. Cl.

| | |
|---|---|
| ***A41D 3/08*** | (2006.01) |
| ***A41D 13/05*** | (2006.01) |
| ***A42B 1/04*** | (2006.01) |
| ***A42B 1/20*** | (2006.01) |

(52) U.S. Cl.

CPC ..... *A41D 13/0512* (2013.01); *A42B 1/048* (2013.01); *A42B 1/203* (2013.01); *A41D 2200/20* (2013.01)

(58) Field of Classification Search

CPC ..... A41D 2200/20; A41D 13/0512; B63C 9/1055

USPC ..... 441/104, 123

See application file for complete search history.

(56) References Cited

U.S. PATENT DOCUMENTS

| | | | | |
|---|---|---|---|---|
| 2,632,176 | A * | 3/1953 | Mitchell | A42B 1/045 2/181.8 |
| 3,397,688 | A * | 8/1968 | Gottfried | A61F 5/05883 128/857 |
| 3,676,879 | A * | 7/1972 | Irie | A42B 1/045 2/202 |
| 4,533,335 | A * | 8/1985 | Hoshino | A41D 13/0125 441/102 |
| 8,393,013 | B2 * | 3/2013 | Bowen | A41D 15/04 2/69 |
| 2012/0255099 | A1 | 10/2012 | Sternberg | |
| 2013/0131566 | A1 | 5/2013 | Bodansky | |

(Continued)

FOREIGN PATENT DOCUMENTS

| | | |
|---|---|---|
| CN | 1093246 A | 10/1994 |
| CN | 202496467 | 10/2012 |

(Continued)

OTHER PUBLICATIONS

CN, English Translation of Search Report issued in corresponding Chinese Patent Application No. (3 pages) (dated Jul. 3, 2017).

(Continued)

*Primary Examiner* — Tejash Patel
(74) *Attorney, Agent, or Firm* — Thompson Hine LLP

(57) ABSTRACT

An upper body article of clothing has a hood and a pump for filling an airtight inflatable inner space in the hood with air or other gas. The inflatable inner space extends along parts of the hood around the neck and over the head of a person wearing the article.

10 Claims, 2 Drawing Sheets

(56) References Cited

U.S. PATENT DOCUMENTS

| | | | | |
|---|---|---|---|---|
| 2013/0152270 | A1* | 6/2013 | Neal | A41D 3/005 2/84 |
| 2015/0223527 | A1* | 8/2015 | Arora | A41D 13/0125 2/86 |

FOREIGN PATENT DOCUMENTS

| | | |
|---|---|---|
| DE | 202 04 335 U1 | 9/2002 |
| DE | 20 2009 010 111 U1 | 12/2009 |
| GB | 2492588 | 1/2013 |
| WO | 2011047417 | 4/2011 |
| WO | 2012044245 | 4/2012 |

OTHER PUBLICATIONS

CN, English Translation of Search Report issued in corresponding Chinese Patent Application No. (3 pages) (Jul. 3, 2017).
PCT, International Search Report, International Application No. PCT/FI2014/050612, 4 pages, Oct. 23, 2014.
PCT, International Preliminary Report on Patentability, International Application No. PCT/FI2014/050612, 6 pages, Feb. 16, 2016.

* cited by examiner

FUNCTIONAL ARTICLE OF CLOTHING

PRIOR APPLICATIONS

This application is a U.S. national phase application based on International Application No. PCT/FI2014/050612, filed 7 Aug. 2014 that claims priority from Finnish Patent Application No. 20135831 filed 14 Aug. 2013.

TECHNICAL FIELD

The invention is concerned with an upper body article of clothing having a hood and means for filling an airtight inflatable inner space in the hood with air or other gas.

BACKGROUND

In airplanes, cars, trains, trams, boats and many other vehicles people are travelling on seats that are intended for sitting. Sleeping well in e.g. airplanes, especially on a long flight, is therefore not easy and it is difficult to find a comfortable position. The seats might be tiltable but usually they can be reclined backwards only to a given extent due to the restricted place reserved for each passenger and seat.

For traveling, having a neck pillow can make resting and sleeping easier for those that have trouble falling asleep in moving vehicles. A neck travel pillow offers support for sleeping on airplanes and in cars but is inconvenient to carry around. The best pillows for neck support will vary on the person and the severity of the pain when trying to sleep in the awkward upright position they have to be in during the travel. Some require a stiff and tight fit while others just need the softest pillow possible.

Known neck pillows are usually u-shaped and either they have an inner foam filling or they are inflatable. These u-shaped pillows provide a help, but they do not solve all problems in view of finding a comfortable sleeping position and keeping the pillow on place. For the best head support while being on the road, a neck travel pillow, even an inflatable one, can also aid in habitual body sores, ailments and problems.

Attempts have been made in constructing comfortable dollies instead.

US patent application 2012/0255099 discloses an outerwear garment that includes a hood with an interior inflatable space to support either the neck or the head of the person wearing it when the space is in an inflated state and having a tubular form. The inflatable space also has a valve and a tubular valve stem extending outwardly from the valve and is configured to receive a removable plug at a distal end of the valve stem.

WO publication 2011/047417 discloses a similar garment with a hood having a neck inflation portion and a lumbar inflation portion. The neck inflation portion may extend to the chin and cheekbones and up to the ears of the wearer to provide a little more support than just to the neck. The garment also includes an inflation tube extending through the jacket lining between the inflation portions and a pocket from which it may be extracted for inflation without removal of the garment. Automatic inflation means may alternatively be provided by pushing a button positioned on the garment to operate a source of compressed gas to expel into the inflatable portions.

DE utility model 20 2009 010 111 U1 is additionally mentioned as prior art comprising a jacket with a hood inside which there is a space to be filled with air for travelling comfort, DE utility model 202 04 335 discloses a garment with an inflatable space inside the hood for protection against sound, wind, rain, snow and cold.

Inflatable hoods have previously been used also in life jackets and masquerade costumes.

The inflatable, spaces in these known solutions, however, are not shaped well enough to provide comfortable support and nor are they able to keep the position of the head stable.

UK patent application GB2492588 attempts to solve the problem with the slumping head of a person trying to sleep on a seat in a pane, train or car by means of a head support of straps. The head support comprises a strap for mounting on the head and additional support straps extending to fastening means mounted around the upper body or breast part of the person wearing the head support. This solution, however, only prevents movement of the head and gives no comfortable neck or head support in itself.

The object of the invention is a solution that fulfills all the problems with comfort and head movement at the same time.

SUMMARY OF THE INVENTION

The upper body article of clothing of the invention has a hood and means for filling an airtight inflatable inner space in the hood with air or other gas. The inflatable inner space extends along parts of the hood around the neck and over the head of a person wearing the article.

The preferable embodiments of the invention have the characteristics of the sub claims.

The inflatable inner space is formed as a sand-which layer inside the hood further extending along those parts of the hood that are on top of the head of the person wearing the article of clothing and behind the neck of the person. In one preferable embodiment, the inner space extends along parts of the hood being against the ears and to the chins and chin bones. The hood extends around the head of a person wearing the article by leaving the face free. The hood but not the inflatable portion, i.e. the inner space, also extends over the back of the head. The inner space has integral neck and head portions giving superior support for both neck and head by not extending over the back of the head.

Any kind of known inflation means for filling portions of clothes with air can be used for transferring air into the inflatable space. Advantageously, a solution presented in e.g. the swim cloth of CN publication 1093246A can be used. Thus, the article of clothing of the invention, such as a garment with an inflatable interior portion as an inner space, can be equipped with a valve air-filled by a rubber ball and a soft tube of e.g. latex for transferring gas or air into the inner space. The aft is filled by pressing the rubber ball whereby the air is passed through the soft tube into the inner space of the hood. In a practical embodiment, the rubber ball is placed inside the article of clothing, such as in a pocket, and the tube is extending preferably inside the article of clothing, e.g. through a lining, between the rubber ball and the hood.

The means for filling the airtight inner space in the hood with air can also be another kind of a manually operated hand pump, air pump, or it can even be filled with the mouth or it can be constructed to be automatically filled by pressing a button.

The article of the invention is in the most preferable embodiment further equipped with one or more straps, belts or rems to adjust the position of the hood and thereby the head to keep the head in a static position.

Different solutions are possible within the inventive idea.

In a first and preferable embodiment, a pair of adjustable first straps is in use extending around the shoulders and the armpit. The pair of the first adjustable straps thus forms an enclosed loop around the shoulder joints and follows a path by passing underneath the armpits. Another adjustable strap transversal to the first straps is extending over the head, the other transversal strap being fastened to the straps of the first pair.

Said adjustable strap that is extending over the head can be connected directly to the first straps or by means of fastening means situated in the first straps at the shoulders of the article of clothing.

In a second embodiment, there might be two transversal straps instead of only one, both extending from the shoulders to the sides of the hood and being fastened to the sides of the hood at approximately on ear height of the head.

The invention provides a perfect solution for travelers in order to find a comfortable and safe position for resting or sleeping when sitting in a vehicle or airplane chair. Already the form (profile) of the inner space in supporting both the neck and the head is an inventive solution since the inflatable portion filled with gas or air has a profile only extending behind the neck and around said portions of the head but not the back of the head. Such a profile gives a better support for the head than the profiles of prior art since those of prior art cause the head to recline backwards against the back rest of the seat. The profile of the inner space together with the straps to be tightened from the sides gives an optimum support and position of the head by helping the user finding the best possible resting position.

The inflatable space can be adapted to be selectively inflated to provide support to both the neck and the head. The form allows the inner space to be filled to a desired extent in order to individually fit the contours and curves of ones' head being also comfortable to the back of the head and the neck. The amount of air or gas can be adjusted depending on how to sleep or rest.

The comfort can even be improved by using adjustable straps for finding a perfect and stable position of the head.

The straps are especially designed to work together with the inflatable inner space in the hood since both the straps and the inflatable space are adjustable to fit personal preferences of the person using the article of clothing of the invention. As the volume of the inflatable inner space can be filled to a desired extent and each strap is adjustable, a lot of different end results for the combined solution of adjustments of the inner space and straps are possible. This solution of the invention keeps the head in a static position and prevents backwards slumping.

The invention provides more comfort to the wearer as the designed form of the inflatable portion optionally together with the adjustable straps ensure less rocking or wobbling of the head of the user particularly if the vehicle or plane is undergoing turbulence, going over bumbs or the like.

The use of the article of clothing of the invention is not restricted to vehicle or airplane chairs only. It can be used in any chair as well by both children and adults in different situations.

The article of clothing of the invention can be a jacket, hoodie, coat, vest, blouse, dress, sweatshirt, t-shirt, tunika, shirt, shoulder clothing, collar assembly, cape or the like. Primarily it is intended to be designed as a jacket, coat, hoodie or sweatshirt.

Next, the invention will be described by referring to an advantageous embodiment by referring to figures. The invention is not restricted to the details of the figures and accompanying text

FIGURES

DETAILED DESCRIPTION

Figure 1:
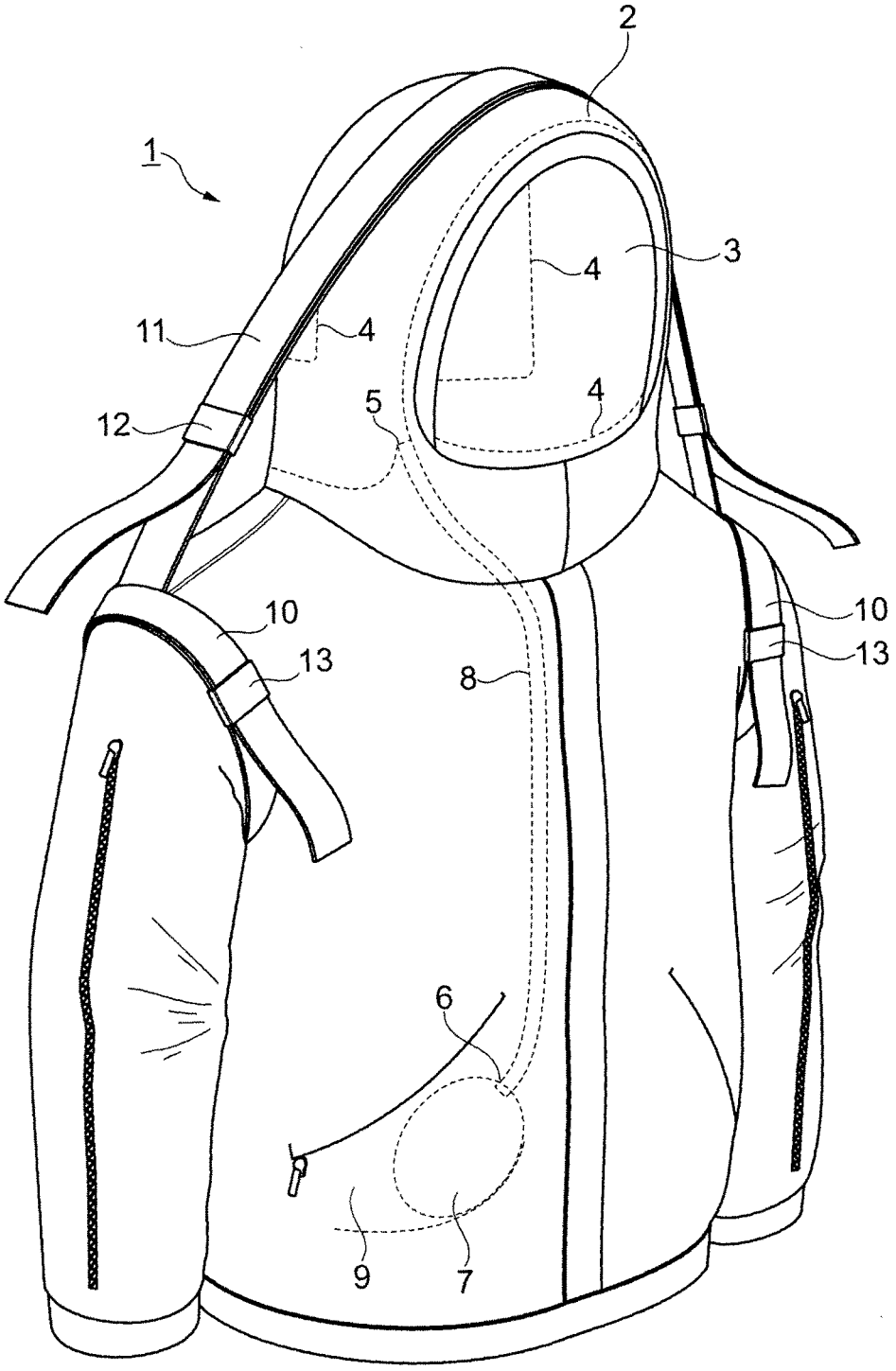
FIG. 1 shows a front view of the article of clothing of the invention

FIG. 1 shows a front view of an article of clothing 1 of the invention, which in FIG. 1 is a jacket having a hood 2 extending around the head by leaving the face free. Inside the hood 2, there is an inflatable inner space 3 that extends integrally around the neck and over the head of a person wearing the article as is shown by dotted lines 4. The inflatable inner space 3 is thus formed in order to support both the neck and the head and therefor extends in vertical direction up and over the head and down again and horizontally around the neck and over the ears and to the chins and chin bones. Thereby, the article also reduces environmental disturbing sounds. The hood 2 but not the inner space also extends over the back of the head.

The inflatable inner space 3 has an inlet for air shown by reference number 5 through which the space 3 can be filled to a desired extent by air. The means for filling the airtight inflatable inner space 3 in the hood 2 with air has a valve 6 air-filled by a rubber bail 7 and a soft tube 8 of e.g. latex for transferring gas or air into the inner space. The soft tube 8 is indicted with another dotted line. The air is filled by pressing the rubber bail 7 whereby the air is passed through the soft tube 8 into the inner space 3 of the hood 2. In the embodiment of FIG. 1, the rubber ball 7 is placed inside the article of clothing 1, such as in a pocket 9, and the tube 8 is extending preferably inside the article of clothing 1, e.g. through a lining in the article, between the rubber ball 7 and the hood 2.

The article of the invention is in the preferable embodiment of FIG. 1 further equipped with straps to adjust the position of the hood 2 and thereby the head to keep the head in a static position.

In FIG. 1, a pair of adjustable first straps 10 with adjusting means 13 is in use extending around the shoulders and the armpit. The pair of the first adjustable straps 10 thus forms an enclosed loop around the shoulder joints and follows a path by passing and underneath the armpits. Another adjustable strap 11 with adjusting means 12 transversal to the first straps 10 is extending over the head, the transversal strap 11 being fastened to the straps 10 of the first pair.

Said transversal adjustable strap 11 that is extending over the head can be connected directly to the first straps 10 or by means of fastening means situated in the first straps 10 at the shoulders of the article of clothing 1.

Figure 2:
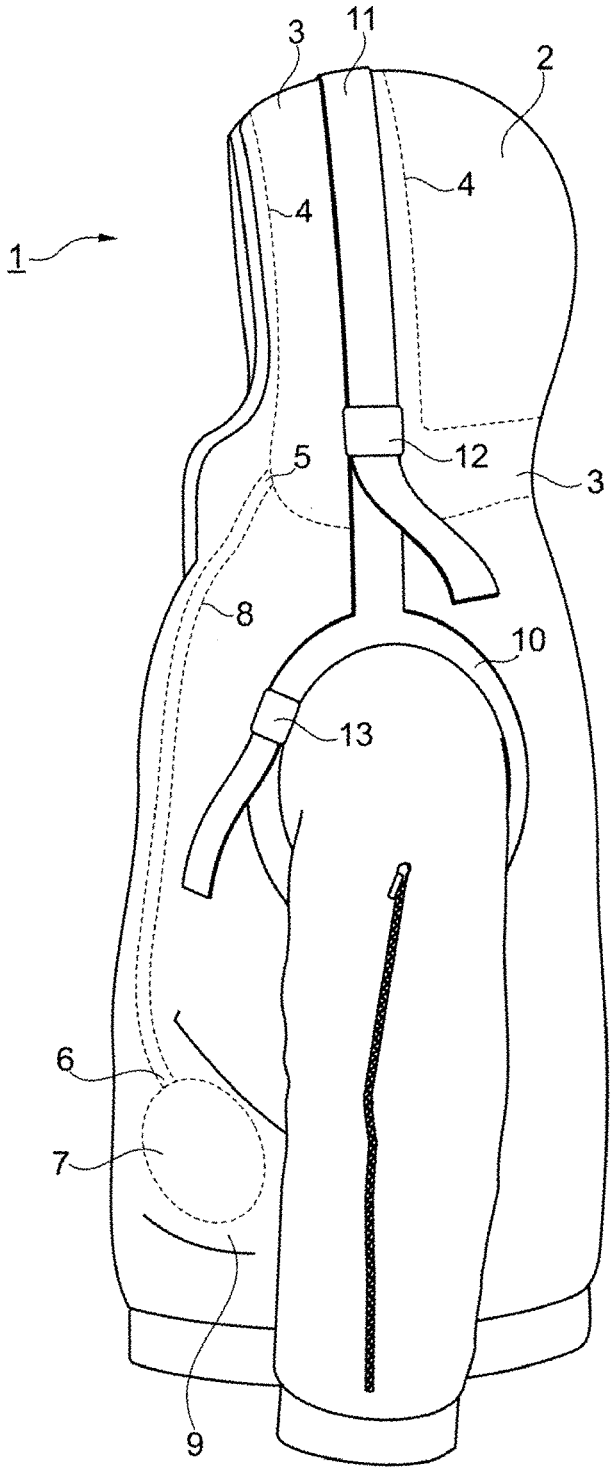
FIG. 2 shows a side view of the article of clothing of the invention

FIG. 2 shows a side view of the article of clothing of the invention. The same reference numbers applies as in FIG. 1. The form of the inners pace 3 can be better seen in FIG. 2 showing its form to support both the neck and the head.

While the present invention has been described in accordance with preferred compositions and embodiments, it is to be understood that certain substitutions and alterations may be made thereto without departing from the spirit and scope of the following claims.

The invention claimed is:

1. An upper body article of clothing, comprising:

a hood and means for filling an airtight inflatable inner space in the hood with air or other gas, the inflatable inner space extending along parts of the hood around a neck and over a head of a person wearing the article, and a first adjustable strap extending over the head wherein the first adjustable strap, that extends over the head, is connected to fastening means on shoulders of the article of clothing for fastening the first adjustable strap.

2. The article of clothing of claim 1 wherein the inflatable inner space further extends along parts of the hood covering ears and to cheeks and cheek bones of the person wearing the article.

3. The article of clothing of claim 1 wherein the means for filling the airtight inner space in the hood with air or other gas is a hand pump.

4. The article of clothing of claim 3, wherein the hand pump is of a manually operated type having a valve that is air-filled by a rubber ball and a soft tube for transferring air via the soft tube to said inner space by pressing the rubber ball.

5. An upper body article of clothing, comprising:

a hood and means for filling an airtight inflatable inner space in the hood with air or other gas, the inflatable inner space extending along parts of the hood around a neck and over a head of a person wearing the article, and a first adjustable strap extending over the head, wherein the means for filling the airtight inner space in the hood with air or other gas is a hand pump of a manually operated type having a valve that is air-filled by a rubber ball and a soft tube for transferring air via the soft tube to said inner space by pressing the rubber ball, wherein the rubber ball is placed inside the article of clothing and the tube extends inside the article of clothing between the rubber ball and the hood.

6. An upper body article of clothing, comprising:

a hood and means for filling an airtight inflatable inner space in the hood with air or other gas, the inflatable inner space extending along parts of the hood around a neck and over a head of a person wearing the article, and a first adjustable strap extending over the head, wherein the inflatable inner space in the hood has a form with integral neck and head portions, the head portions extending on top and over the head and the neck portion extending behind the neck, the inflatable inner space leaving free a back of the person wearing the article.

7. An upper body article of clothing, comprising:

a hood and means for filling an airtight inflatable inner space in the hood with air or other gas, the inflatable inner space extending along parts of the hood around a neck and over a head of a person wearing the article, and a first adjustable strap extending over the head, wherein the inflatable inner space in the hood has a form with neck and head portions, that is selectively inflatable, the head portion extending on top and over the head and the neck portion extending behind the neck, the inflatable inner space leaving free a back of the person wearing the article.

8. The article of clothing of claim 1, wherein the first adjustable strap, that extends over the head, has adjusting means for adjusting the first adjustable strap.

9. The article of clothing of claim 7, wherein a pair of second adjustable straps extends around shoulders and armpits of the person wearing the article and the first adjustable strap extends over the head, the first adjustable strap is fastened to the second adjustable straps.

10. The article of clothing of claim 1, wherein the article is a jacket, hoodie, coat, vest, blouse, dress, sweatshirt, t-shirt, tunica, shirt, shoulder clothing, collar or cape.

* * * * *